US005636772A

United States Patent [19]

Poulsen

[11] Patent Number: 5,636,772

[45] Date of Patent: Jun. 10, 1997

[54] FLUID CONTAINER WITH COMPRESSION BREAKABLE INTERIOR SEAL

[76] Inventor: Thomas E. Poulsen, P.O. Box 281151, Lamoille, Nev. 89828

[21] Appl. No.: 482,946

[22] Filed: Jun. 7, 1995

[51] Int. Cl.[6] ..... B65D 47/10

[52] U.S. Cl. ..... 222/541.6

[58] Field of Search ..... 222/541.4, 541.6

[56] References Cited

U.S. PATENT DOCUMENTS

| | | | |
|---|---|---|---|
| 2,802,608 | 8/1957 | Gassaway | 222/541.6 X |
| 4,789,082 | 12/1988 | Sampson | 222/541.4 X |
| 4,938,390 | 7/1990 | Markva | 222/541.4 |
| 4,949,857 | 8/1990 | Russell | 222/541.4 |
| 5,316,058 | 5/1994 | Spektor et al. | 222/541.6 X |

*Primary Examiner*—Gregory L. Huson

[57] ABSTRACT

A fluid container, especially one formed of plastic, including a hollow body and a neck portion with an opening at the end thereof. A breakable seal for holding the fluid in the container is positioned in the neck between the hollow body and the container opening at the end of the neck. A cap at the container opening is optional but preferred. With the cap removed and the container tilted up side down with the container opening positioned inside or above the fluid receptacle, compression of the outside of the neck adjacent or nearly adjacent to the seal inside the neck, as applied with thumb and forefinger, causes the seal to break or separate allowing fluid to flow from the container into the receptacle without spillage.

12 Claims, 2 Drawing Sheets

FLUID CONTAINER WITH COMPRESSION BREAKABLE INTERIOR SEAL

A Disclosure Document has been filed on this invention, Disclosure Document number 350,764, dated Mar. 22, 1994.

BACKGROUND OF THE INVENTION

This invention relates to fluid containers, and especially disposable fluid containers.

Pouring fluid from a container into a relatively small opening often results in spillage of the fluid. This is especially true when the fluid container is full or nearly full. A good example of this is the problem many people encounter when pouring motor oil into an automotive engine. Typically, spillage often occurs when using containers from which fluids are poured by tilting those containers.

It is, therefore, an object of this invention to provide a container for holding and dispensing of a fluid (or flowable) type substance from which the fluid can be poured or transferred without spilling or otherwise getting it where it is not wanted. It is a further object of this invention to provide such a container that can be manufactured inexpensively.

SUMMARY OF THE INVENTION

In the embodiments shown, a fluid container (preferably formed of plastic) includes a relatively long neck. A seal for holding the fluid in the container is positioned inside the neck at a location between the container opening at the end of the neck and the main body of the container. Preferably, a screw or snap on type cap also covers the opening.

While dispensing of the fluid from the container, after any cap covering the opening has been removed, the container is turned up side down and the opening is placed into or above the hole into which the fluid is to be dispensed. The outside of the neck is then squeezed at a position adjacent to or nearly adjacent to the specially designed seal inside the neck. This causes the portion of the neck where the seal is located to chance in shape, causing the seal (formed of paper or foil or another material of similar properties) to rip or separate allowing the fluid to flow from the container into its proper receptacle without spillage.

DETAILED DESCRIPTION

Figure 1:
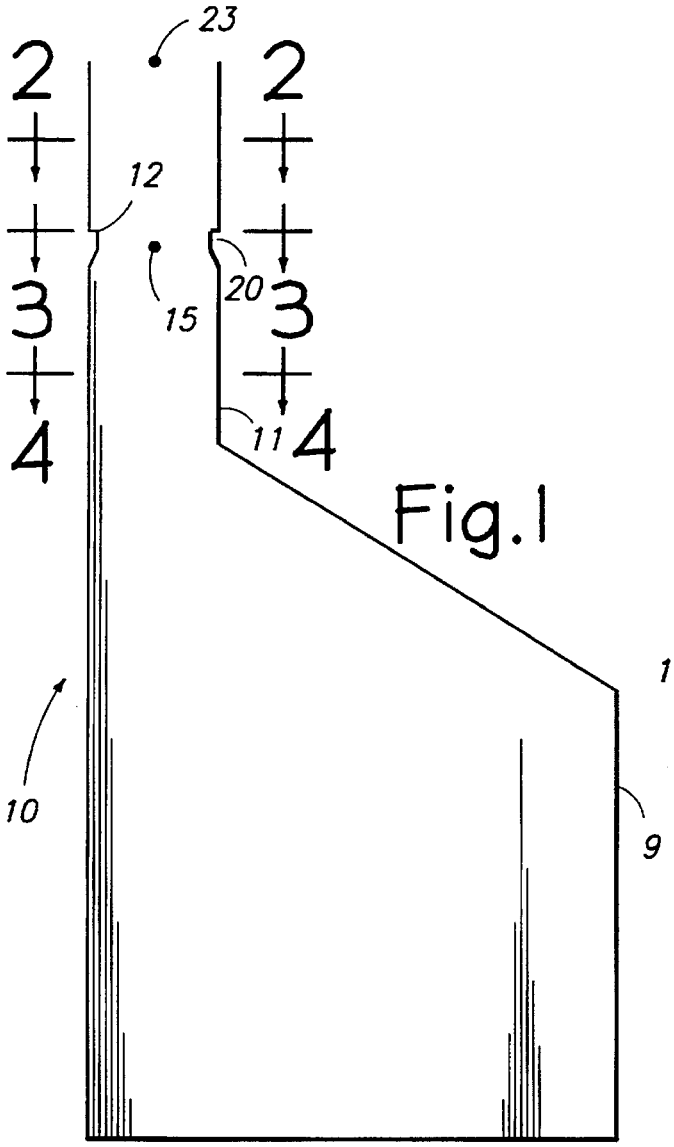
FIG. 1 is a cross-sectional view of the new container shown from the side, without the seal.
Figure 2:
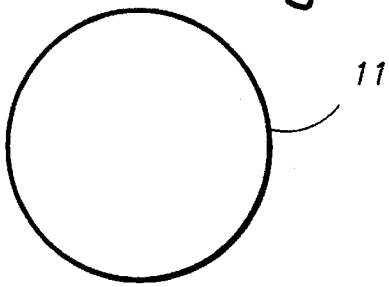
FIG. 2 is a cross-sectional view taken along the line 2—2 of FIGS. 1 and 8.
Figure 8:
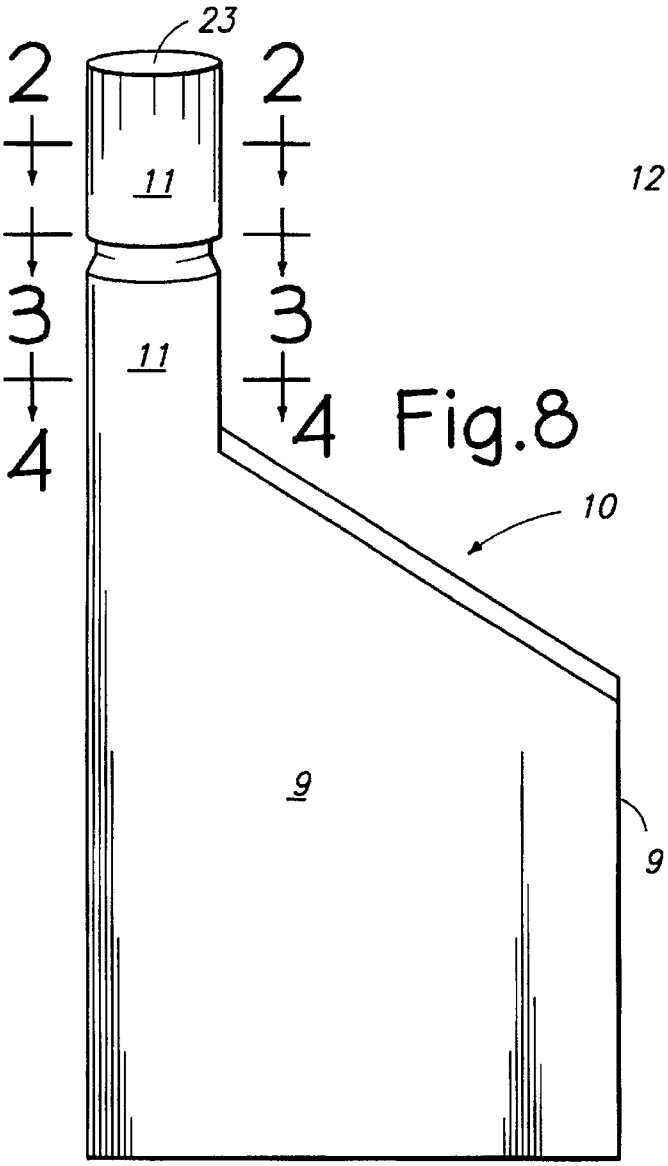
FIG. 8 is a perspective, two dimensional view of the container taken from the side.
Figure 7:
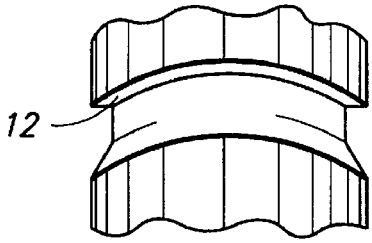
FIG. 7 is a cut away view of a portion of the inside of the neck of the container, showing a portion of the rim (from the inside).
Figure 6:
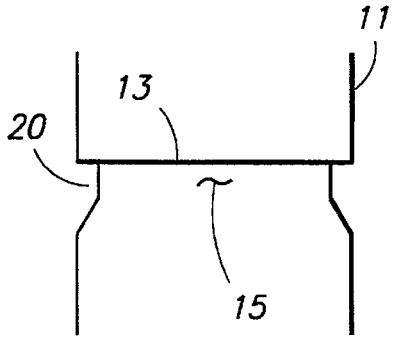
FIG. 6 is a cross-sectional view of the portion of the neck of the container where the rim is located, shown with the seal in place.

In the embodiment shown in FIGS. 1 and 8, the container would include a neck 11 and a hollow body 9, and may also include an outer cap or top such as a screw or snap on type cap (not shown) to cover the outer opening 23. Ideally, the container would be formed of plastic or similar material, and would be formed by the blow molding process.

An inner rim 12 extends inward around the inside of the neck 11, making a complete circle around the neck 11, thus forming an inner opening shown generally as 15. A corresponding circular depression 20 may encircle the outside of the neck 11 if the container 10 is formed of plastic using the blow molding process. It is anticipated that such a container as herein described could be manufactured of plastic using the blow molding process.

A tearable seal 13 similar or identical (though possibly thinner) to those seals commonly placed on plastic containers containing automotive engine oil or anti-freeze for example (perhaps formed of a foil type material, though not limited to such a material) would be attached to the top surface of the inner rim 12 after the fluid contents of the container 10 have been placed inside the container 10, thus sealing such fluid inside the container 10. Of course, if a manufacturing or packaging process exists, the contents of the container 10 could alternately be placed inside the container 10 after the seal 13 is in place (as, for example, if a process exists or is developed where the contents may be inserted through the container wall, which would then be sealed). If desired, an additional seal may be located on the outer opening 23 of the container, but such a seal is optional.

The manner in which the seal 13 is attached to the inner rim 12 in the manufacturing process may be similar or identical to the manner in which similar seals are secured to (outer) openings of conventional containers. However, a different process may also be employed for securing the seal 13.

Figure 3A:
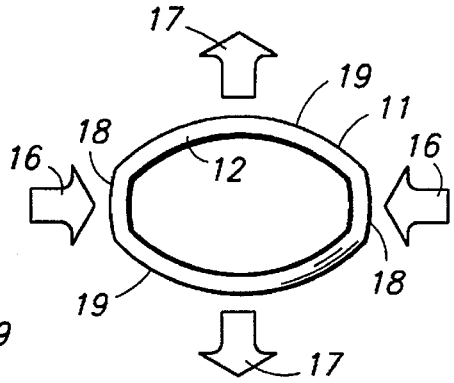
FIG. 3*a* is a cross-sectional view taken along the line 3—3 of FIGS. 1 and 8 showing one embodiment of the container without the seal in place.
Figure 3B:
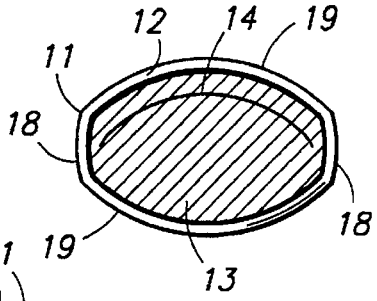
FIG. 3*b* is a cross-sectional view taken along the line 3—3 of FIGS. 1 and 8 showing the embodiment of FIG. 3*a* with the seal in place. The line 14 represents an optional linear feature where the seal 13 is thin or otherwise made weak in order that the seal will rip apart along this line.
Figure 4:
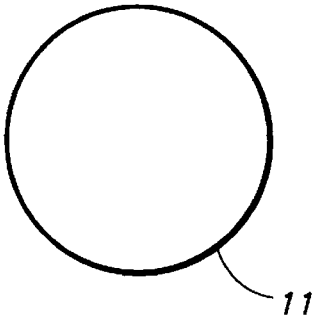
FIG. 4 is a cross-sectional view taken along the line 4—4 of FIGS. 1 and 8.

A cross-sectional view of the container taken along the line 3—3 of FIGS. 1 and 8, is depicted in FIG. 3*a* (shown without the seal 13) and FIG. 3*b* (shown with the seal 13 in place).

Figure 3C:
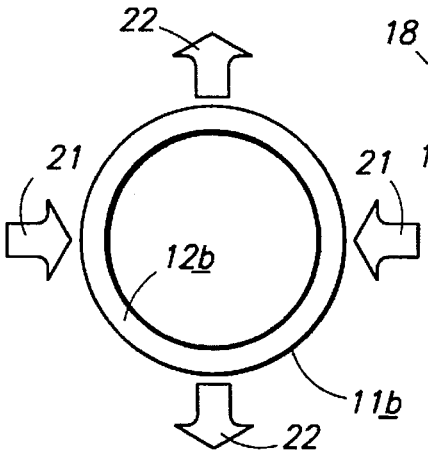
FIG. 3*c* is a cross-sectional view taken along the line 3—3 of FIGS. 1 and 8 showing another embodiment of the container without the seal.
Figure 3D:
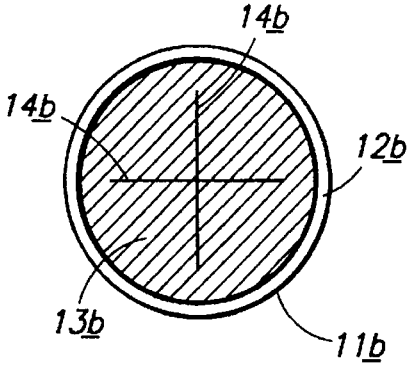
FIG. 3*d* is a cross-sectional view taken along the line 3—3 of FIGS. 1 and 8 showing the embodiment of FIG. 3*c* with the seal in place.
Figure 5:
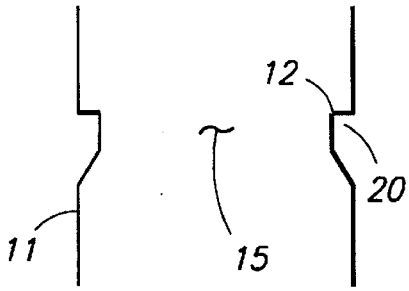
FIG. 5 is a cross-sectional view of the portion of the neck of the container where the rim is located, shown without the seal.

FIG. 3*c* shows the same view (a cross-sectional view taken along the line 3—3 of FIGS. 1 and 8) of an alternate embodiment, shown without the seal 13*b*, while FIG. 3*d* shows this view of the embodiment of FIG. 3*c* with the seal 13*b* in place.

In practice, after the outer cap (not shown) is removed (if one is used), the container is tilted up side down so that the outer opening 23 is facing downward. The outer opening 23 is then placed over or inside the opening of the container or receptacle into which the fluid is to be dispensed (as the opening for receiving automotive engine oil in an automotive engine for example). The person dispensing the fluid would then squeeze inwardly on the neck 11, against the sides 18 (FIGS. 3*a* and 3*b*), at a position along the neck 11 adjacent to or nearly adjacent to the rim 12 as indicated by arrows 16 (FIG. 3*a*).

This motion causes the adjacent sides 19 of the neck 11 to move outward breaking or ripping the seal 13, thus allowing the fluid to flow downward and out the outer opening 23.

The seal 13 may, if desired, include one or more straight or curved linear features 14 (shown in FIG. 3*b*) that is thinner or otherwise made weaker than the remainder of the seal 13 so that the seal 13 will tend to tear or separate along such a line 14. This line 14 could make the seal 13 easier to tear and also help assure that no pieces of the seal 13 will fall into the fluid. Such a weak linear feature would, of course, still be fluid proof.

As can be seen from FIGS. 3*a* and 3*b*, the neck 11 of the container 10 is not round in cross-section at the position where the rim 12 is located. However, in a slightly different embodiment shown in FIGS. 3*c* and 3*d*, the portion of the neck 11*b* where the rim 12*b* is located is round. In this embodiment too, squeezing inwardly on the outside of the neck 11*b* at two positions roughly 180 degrees apart, at a location adjacent or nearly adjacent to the rim 12*b*, would cause the two adjacent sides or portions of the neck 11*b* to move outward thus breaking the seal 13*b* (shown in FIG. 3*d*). The direction of such inward pressure on the neck 11*b* is indicated in FIG. 3*c* by arrows 21, while outward movement of the neck 11*b* is indicated by arrows 22. The seal 13*b* may, if desired, include one or more straight or curved linear features 14*b* that, as with the similar linear feature 14 of FIG. 3*b*, is thinner or otherwise made weaker than the remainder of the seal 13*b* so that the seal 13*b* will tend to tear or separate along one or more of these features 14*b*. In this embodiment, two such linear features 14*b* form a cross or "X".

It is also noted that a seal, as seal 13 or 13*b* could be made to tear or separate by bending the neck (as neck 11 or 11*b*). This could be accomplished by grasping a portion of the neck below the seal with one hand (or one or more fingers and a thumb) and grasping the body of the container or a portion of the neck above the seal with the other hand. The neck could then be bent, which, if done properly, could break the seal.

While several embodiments and modifications thereto of the invention have been shown and described herein as best modes for carrying out the invention, it should be understood that changes and modifications may be made thereto without departing from the subject matter coming within the scope of the invention and the following claims.

I claim:

1. A fluid container comprising:

a) a hollow body for containing a fluid; b) a hollow neck including a compressible portion thereof, said neck being connected with said hollow body so that fluid can pass from inside said hollow body through said neck;

c) an outer opening on the distal end of said neck; d) a breakable sealing means located in said compressible portion of said neck, at some distance from said outer opening, said sealing means being capable, when unbroken, of preventing fluid from passing from inside said hollow body through said outer opening, said sealing means being breakable by compressing or otherwise partially collapsing said neck at a location adjacent to said sealing means, so that said outer opening can be positioned inside a fluid receptacle inlet while said sealing means is broken by hand manipulation of said neck outside said fluid receptacle inlet.

2. The fluid container of claim 1, wherein said container is comprised of plastic.

3. The fluid container of claim 2, wherein said hollow body is blow molded.

4. The fluid container of claim 1, wherein said seal includes at least one linear or elongate portion that is the weakest portion thereof, where said seal will tend to tear or separate.

5. The fluid container of claim 2, wherein said seal includes at least one linear or elongate portion that is the weakest portion thereof, where said seal will tend to tear or separate.

6. The fluid container of claim 3, wherein said seal includes at least one linear or elongate portion that is the weakest portion thereof, where said seal will tend to tear or separate.

7. A fluid container comprising:

a) a hollow body for containing a fluid;

b) a hollow neck including a compressible portion thereof, said neck being connected with said hollow body so that fluid can pass from inside said hollow body through said neck;

c) an outer opening on the distal end of said neck;

d) a breakable sealing means located in said compressible portion of said neck, at some distance from said outer opening, said sealing means being capable, when unbroken, of preventing fluid from passing from inside said hollow body through said outer opening, said sealing means being breakable by compressing said neck at a location adjacent to said sealing means, whereby said outer opening can be positioned inside a fluid receptacle while said sealing means is broken by a person squeezing said neck outside said fluid receptacle.

8. The fluid container of claim 7, wherein said container is comprised of plastic.

9. The fluid container of claim 8, wherein the container body is blow molded.

10. The fluid container of claim 7, wherein said seal includes at least one straight or curved linear portion that is the weakest portion thereof, where said seal will tend to rip or separate.

11. The fluid container of claim 8, wherein said seal includes at least one straight or curved linear portion that is the weakest portion thereof, where said seal will tend to rip or separate.

12. The fluid container of claim 9, wherein said seal includes at least one straight or curved linear portion that is the weakest portion thereof, where said seal will tend to rip or separate.

* * * * *